United States Patent [19]

Zattoni

[11] 4,083,487

[45] Apr. 11, 1978

[54] SAFETY PACKAGE OF TOOTHPICK HOLDER

[76] Inventor: Reinaldo Rela Zattoni, Rue Benedita de Oliveira, 112, Itatiba, Sao Paulo, Brazil

[21] Appl. No.: 758,050

[22] Filed: Jan. 10, 1977

[51] Int. Cl.[2] ..... B65D 5/72

[52] U.S. Cl. ..... 229/38; 229/17 R; 229/44 R; 229/7 R; 229/33

[58] Field of Search ..... 229/7 R, 44 R, 33, 17 R, 229/38, 39 R

[56] References Cited

U.S. PATENT DOCUMENTS

| | | | |
|---|---|---|---|
| 2,020,663 | 11/1935 | Stapleford | 229/17 R |
| 2,330,466 | 9/1943 | Bergstein | 229/17 R |
| 2,368,864 | 2/1945 | Molet | 229/17 R |
| 2,775,388 | 12/1956 | Nerenberg | 229/17 R |
| 3,038,650 | 6/1962 | Asman | 229/33 |
| 3,153,504 | 10/1964 | Mischel et al. | 229/17 R |
| 3,606,135 | 9/1971 | Rosenburg, Jr. | 229/51 TS |
| 3,669,341 | 6/1972 | Hughes | 229/33 |

*Primary Examiner*—William Price
*Assistant Examiner*—Joseph M. Moy
*Attorney, Agent, or Firm*—Benasutti Associates, Ltd.

[57] ABSTRACT

Patent of invention "SAFETY PACKAGE OF TOOTHPICK HOLDER", comprising a cardboard, equipped with sides and an edge for glueing one side, all sides creased and folded by means of creases in order to form a package. Fastened to the sides are edges overlaying one another, forming the cover, which is provided with a hole for the output of toothpicks. Similar edges form the bottom. Safety locking is provided by means of ears on one edge which are inserted in cuttings and openings in the remaining edges and then locking the cover by means of the locking cuttings on the ears.

1 Claim, 8 Drawing Figures

SAFETY PACKAGE OF TOOTHPICK HOLDER

BACKGROUND OF THE INVENTION

The present invention refers to containers for keeping toothpicks in good hygienic condition and yielding these toothpicks only through contact of the human hand of the user.

It is known by the experts on this capacity, that several ways of packing have appeared in the market, turning them touched only by the user's hands, and some of it including new characteristics for this purpose, and still other primitives requiring a sheet around them, leaving exposed the remaining toothpicks. Even the more perfect packages could not stand the user's curiosity, who pressed the packages, spoiling the remaining toothpicks.

SUMMARY OF THE INVENTION

Having in mind to compete in creativity with the best toothpick packages and to offer to the consumer market a way of preserving the toothpicks during transportation, and when exposed in the supermarket stands, making possible its use by the outlet of toothpicks one by one, the inventor has created the package, the object of this application, which comprises a box cut in light cardboard or any other means of packing or box material, such as plastic, and having creases made by the folding machine and special profile cuttings, which fit into grooves previously placed, in such a way as to allow its perfect and safe closing, and the individual outlet of toothpicks, that is achieved by means of combined perforations.

In order that one may have a perfect picture and knowledge of this Patent, it is represented in the appended drawings, and depicted in the descriptive report, showing the best way of presenting the invention.

DESCRIPTION OF THE PREFERRED EMBODIMENT

Figure 1:
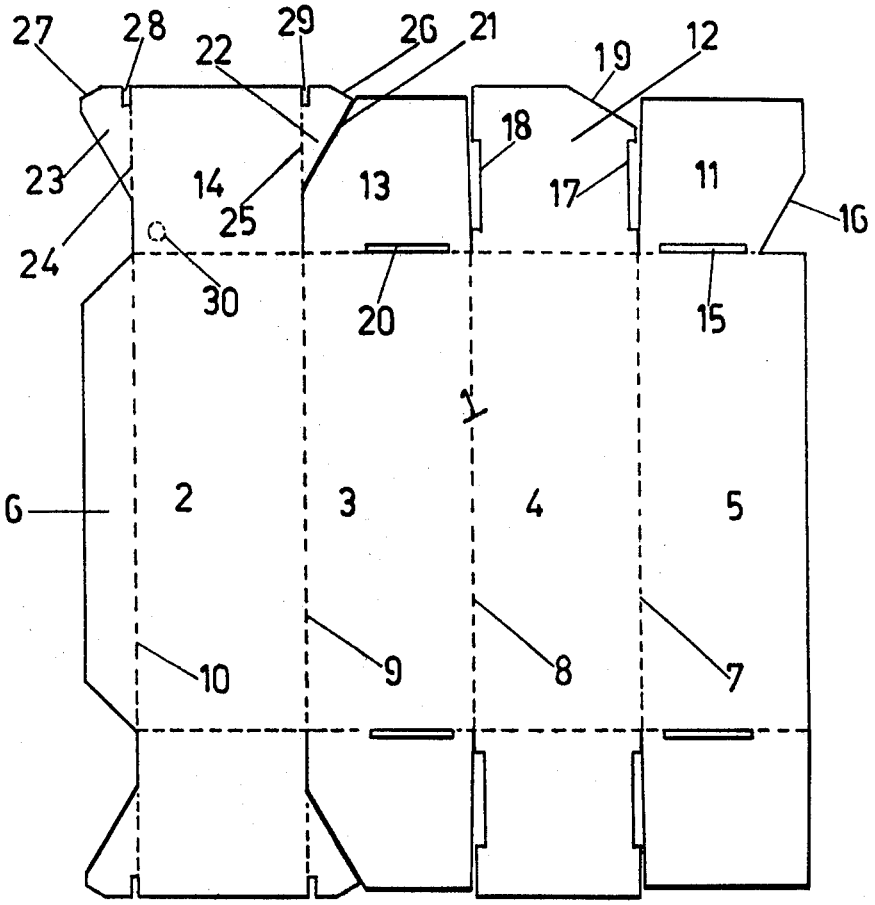
FIG. 1 is a view of the cut cardboard, with respective creases.
Figure 2:
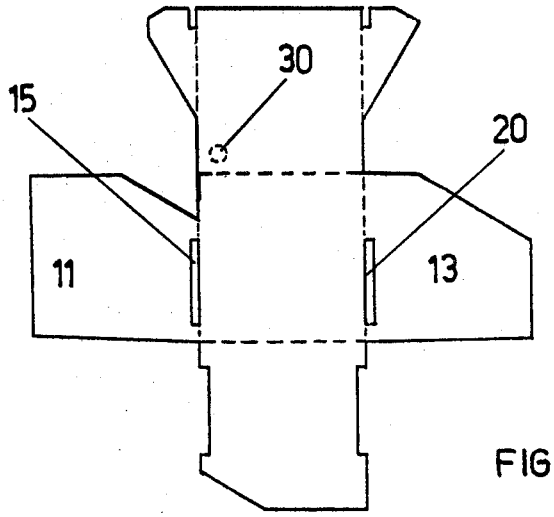
FIG. 2 is a view of the package upper part, with its four edges outfolded.
Figure 3:
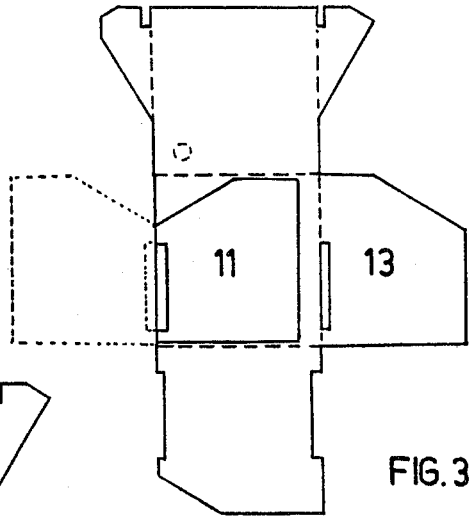
FIG. 3 is a view equal to FIG. 2, with an edge folded inwards and three edges folded outwards.
Figure 4:
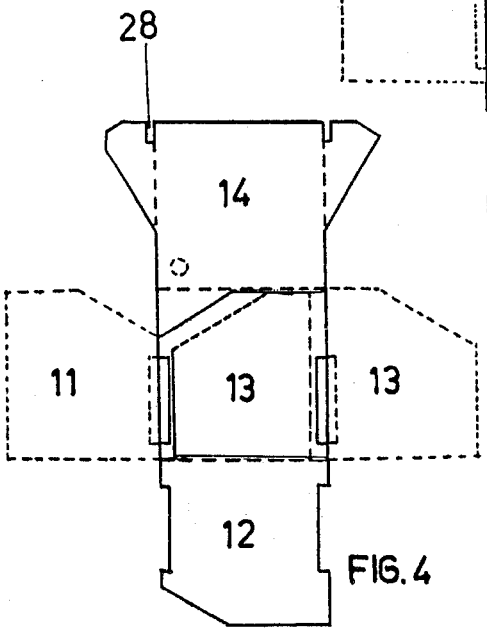
FIG. 4 is a view equal to FIG. 2, with two edges folded inwards and two edges folded outwards.
Figure 5:
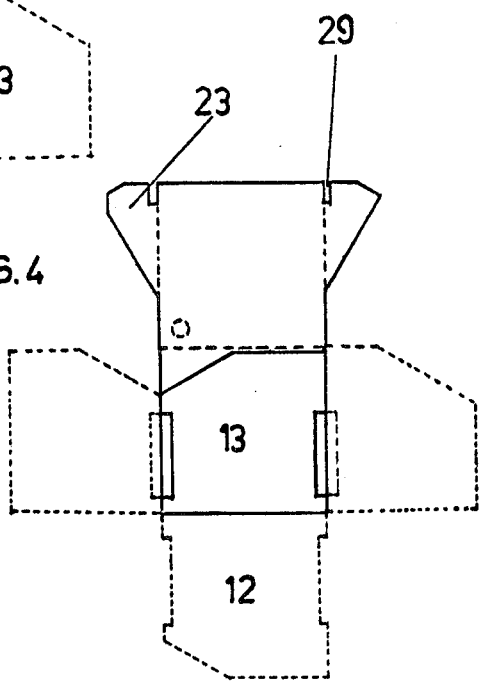
FIG. 5 is a view equal to FIG. 2, with three edges folded inwards and one folded outwards.
Figure 6:
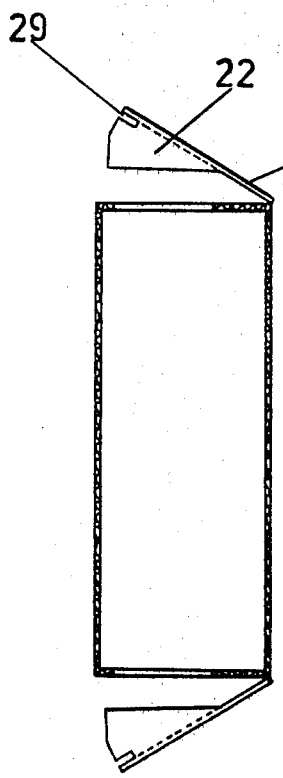
FIG. 6 is a view in vertical projection, partially cross section.
Figure 7:
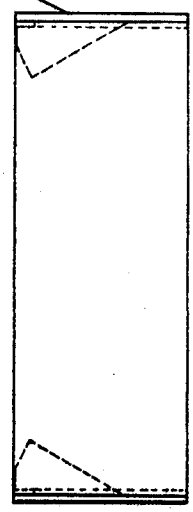
FIG. 7 is a vertical projection of the closed package.
Figure 8:
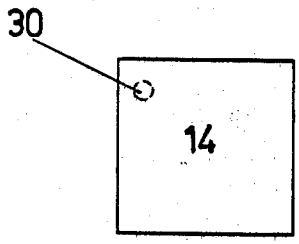
FIG. 8 is an upper view of the package.

With reference to the mentioned drawings, now in more detail, the No. 1 comprises a creased and cut package, being formed by a sufficient number of sides in order to create an internal useful space, to contain the toothpicks which may assume the triangled, sixangled or the square shapes or even another shape, as in the present case, in a parallelepipe shape formed by sides 2, 3, 4 and 5. The side 3 possesses an edge 6, to be glued to side 5; and intercalated to sides 2, 3, 4 and 5 are the creases 7, 8, 9 and 10 which complete the sides. The edges 11, 12, 13 and 14 overlay one another to form the cover, in which the edge 11 possesses an opening 15 and a triangular cutting 16; the edge 12 has side cuttings 17 and 18 and a triangular cutting 19; in the edge 13 there is only one opening 20 and a triangular cutting 21 which is formed when making the ear 22. The edge 14 has side ears 22 and 23, creased by means of creases 24 and 25, and bevels 26 and 27, with locking cuttings 28 and 29 with the mentioned ears used to lock the package. After the folding of edges 11, 12 and 13 one upon another, free space in the openings 15 and 20 is left to insert ears 22 and 23, which cross and lock the cover, making it totally safe. The output hole 30 for the toothpicks also is situated in a corner of cover 14, with a crease in all its surface, and is only broken when used. Such hole 30 coincides exactly with the triangular cuttings 16, 19 and 21, inside. The lower portion of the package (toothpick holder), that is, the bottom, follows the same pattern of the cover cuttings and creases, with the difference that it does not require cuttings 16 and 19, for in the bottom, there is no need of hole 30.

As it is easily understood, the description of the components of this invention and its utility in packages for toothpick holders and others, of easy mounting and safety locking of perfect industrialization, deserves the claimed privilege.

It will be understood that various changes in the details, materials and arrangement of parts which have been herein described and illustrated in order to explain the nature of this invention, may be made by those skilled in the art within the principle and scope of the invention as expressed in the following claim.

What is claimed is:

1. A safety package for holding and dispensing toothpicks in a sanitary way, comprising:

(a) a plurality of sides and a gluing edge attached to one of said sides, all creased by means of creases for forming the package sides;

(b) a plurality of bottom edges fastened to said sides which overlay one another to form a bottom;

(c) a plurality of cover edges fastened to said sides which overlay one another to form a cover, said cover edges further comprising:

(i) a pair of edges having an opening;

(ii) at least one edge having a pair of side cuttings for overlaying said openings when said edges are overlaid to form said cover;

(iii) at least one edge having a pair of creased ears for insertion into said openings through said cuttings when said edges are overlaid, said at least one edge having said ears also having a creased portion in a corner of said edge for breaking and allowing individual access; and (iv) at least three edges having triangular cuttings which, when said plurality of cover edges are overlaid, are in substantial alignment and overlay said creased portions, whereby said creased portions can be broken and said toothpicks dispensed.

* * * * *